US010490072B2

(12) United States Patent
Makke et al.

(10) Patent No.: US 10,490,072 B2
(45) Date of Patent: Nov. 26, 2019

(54) EXTENDED RANGE VEHICLE HORN

(71) Applicant: Ford Global Technologies, LLC, Dearborn, MI (US)

(72) Inventors: Omar Makke, Lyon Township, MI (US); Perry Robinson MacNeille, Lathrup Village, MI (US); Cynthia M. Neubecker, Westland, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 16/060,202

(22) PCT Filed: Dec. 8, 2015

(86) PCT No.: PCT/US2015/064412
§ 371 (c)(1),
(2) Date: Jun. 7, 2018

(87) PCT Pub. No.: WO2017/099723
PCT Pub. Date: Jun. 15, 2017

(65) Prior Publication Data

US 2018/0365993 A1 Dec. 20, 2018

(51) Int. Cl.
*G08G 1/0967* (2006.01)
*G08G 1/005* (2006.01)
*G08G 1/16* (2006.01)

(52) U.S. Cl.
CPC ..... *G08G 1/096741* (2013.01); *G08G 1/005* (2013.01); *G08G 1/096716* (2013.01); *G08G 1/096791* (2013.01); *G08G 1/162* (2013.01)

(58) Field of Classification Search
CPC ..... G08G 1/096741; G08G 1/005; G08G 1/096716; G08G 1/096791; G08G 1/162
USPC ..... 340/902
See application file for complete search history.

(56) References Cited

U.S. PATENT DOCUMENTS

| | | | | |
|---|---|---|---|---|
| 7,269,452 | B2 | 9/2007 | Cheung et al. | |
| 2004/0246144 | A1 | 12/2004 | Siegel et al. | |
| 2007/0111672 | A1* | 5/2007 | Saintoyant ..... | H04W 76/14 455/73 |

(Continued)

FOREIGN PATENT DOCUMENTS

| | | | |
|---|---|---|---|
| CN | 104158887 | A | 11/2014 |
| CN | 204288814 | U | 4/2015 |

(Continued)

OTHER PUBLICATIONS

International Search Report and Written Opinion dated Feb. 9, 2016 re Appl. No. PCT/US15/64412.

*Primary Examiner* — Kerri L McNally
(74) *Attorney, Agent, or Firm* — Brandon Hicks; Bejin Bieneman PLC

(57) ABSTRACT

A vehicle system includes a communication device programmed to transmit alert signals from a host vehicle to at least one target vehicle. A user interface device is programmed to present a graphical representation of the at least one target vehicle and receive a user input representing a selection of the at least one target vehicle. A processing device is programmed to command the communication device to transmit the alert signal to the selected at least one target vehicle in response to the user interface device receiving the user input representing the selection of the at least one target vehicle.

14 Claims, 4 Drawing Sheets

(56) References Cited

U.S. PATENT DOCUMENTS

| | | | | |
|---|---|---|---|---|
| 2007/0159354 | A1 | 7/2007 | Rosenberg | |
| 2007/0162550 | A1* | 7/2007 | Rosenberg | H04L 51/04 709/206 |
| 2009/0174573 | A1 | 7/2009 | Smith | |
| 2009/0226001 | A1 | 9/2009 | Grigsby et al. | |
| 2009/0231432 | A1* | 9/2009 | Grigsy | G08G 1/161 348/149 |
| 2010/0019932 | A1* | 1/2010 | Goodwin | G08G 1/162 340/902 |
| 2013/0138591 | A1* | 5/2013 | Ricci | H04W 4/90 706/46 |
| 2016/0264047 | A1* | 9/2016 | Patel | B60Q 9/008 |
| 2017/0132922 | A1* | 5/2017 | Gupta | G08G 1/0962 |

FOREIGN PATENT DOCUMENTS

| | | | |
|---|---|---|---|
| CN | 204323189 | U | 5/2015 |
| GB | 2514267 | A | 11/2014 |
| WO | 2003085619 | A1 | 10/2003 |

* cited by examiner

EXTENDED RANGE VEHICLE HORN

BACKGROUND

Sometimes, a driver of one vehicle wants to get the attention of a driver of another vehicle or of a pedestrian. Most vehicles have horns that beep in response to the driver pressing the center of the steering wheel. Although terse, beeping a horn can get the attention of the other driver or of a pedestrian as well as anyone else in the vicinity.

DETAILED DESCRIPTION

Figure 1:
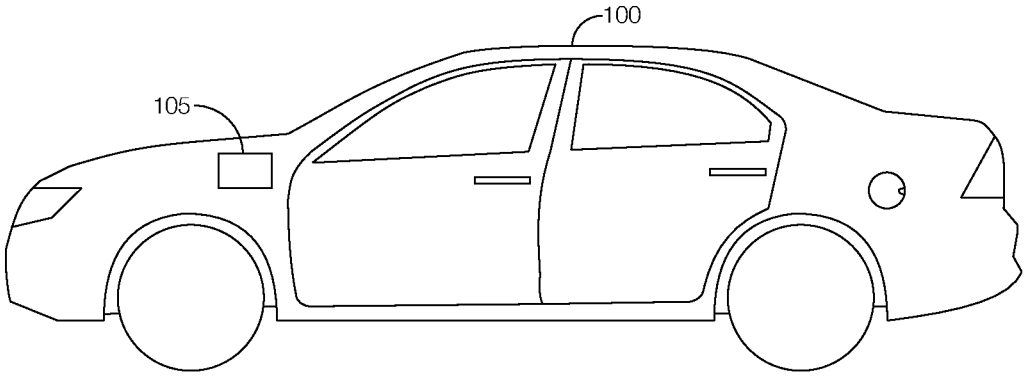
FIG. 1 illustrates an example host vehicle having a system that can simulate alert sounds from alert signals received from other vehicles and transmit alert signals to other vehicles.

While sometimes effective, a horn beep is not always the best way to get the attention of another driver or of a pedestrian. A horn beep in a relatively quiet neighborhood can be seen as obtrusive or offensive, especially since it can be heard by those other than the intended recipient. In louder areas, such as a downtown urban area, a horn beep may be ineffective because the sound may be drowned out by other noise. Further, the horn beep may not be heard by the intended recipient if, e.g., the intended recipient is listening to loud music in his or her car, wearing headphones, on a phone call, or otherwise not paying attention or unable to hear the horn beep.

One way to address these issues is to allow occupants of a host vehicle to transmit alert signals directly to one or more nearby vehicles or one or more nearby pedestrians' mobile devices. In response to receiving the alert signal, the nearby vehicle or mobile device simulates alert sounds such as a horn beep to notify the occupant or pedestrian that the horn beep was intended for him or her. Moreover, the host vehicle may receive alert signals from remote devices, such as nearby vehicles or nearby pedestrians' mobile devices, that cause the host vehicle to play a horn beep or other alert sound for the occupants of the host vehicle. Thus, not only can the host vehicle send alert signals to particular recipients, the host vehicle can be a recipient of alert signals transmitted from remote devices.

An example vehicle system that allows the host vehicle to send alert signals, receive alert signals, or both, includes a communication device, a user interface device, and a processing device. The communication device is programmed to transmit alert signals from the host vehicle to at least one target vehicle or pedestrian. The user interface device presents a graphical representation of the target vehicle or pedestrian and receives a user input representing a selection of the target vehicle, the pedestrian, or both. A processing device is programmed to command the communication device to transmit the alert signal to the selected target vehicle or pedestrian, whichever the case may be, in response to the user interface device receiving the user input representing the selection.

The communication device may be further programmed to receive alert signals transmitted from remote devices such as other vehicles or mobile devices carried by nearby pedestrians. Upon receipt of an alert signal, the processing device may cause an alert sound, such as a horn beep, to be played in the passenger compartment of the host vehicle.

Accordingly, the vehicle system allows the driver of the host vehicle to select particular recipients of the horn beep, which may increase the likelihood that the horn beep will be heard and acknowledged by the intended recipient. Further, the vehicle system permits the host vehicle to receive alert signals from other nearby vehicles and pedestrians.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

As illustrated in FIG. 1, a host vehicle 100 includes an alert simulator system 105. The alert simulator system 105 is programmed to communicate an alert signal, such as a horn beep, to other nearby vehicles. The alert simulator system 105 may be programmed to communicate with other vehicles in accordance with a vehicle-to-vehicle (V2V) communication scheme. Alternatively or in addition, the alert simulator system 105 may communicate with infrastructure devices via a vehicle-to-infrastructure (V2I) communication scheme. For instance, the alert simulator system 105 may transmit alert signals to, or receive alert signals from, other vehicles either directly or via an infrastructure device such as a communication device mounted to a bridge, traffic control device, road sign, etc.

The alert signal may be generated in response to a user input selecting one of the nearby vehicles. For instance, the alert simulator system 105 may present an occupant with a graphical representation of the nearby vehicles, and the occupant may select one of the nearby vehicles as a target vehicle. The alert simulator system 105 may transmit the alert signal to the selected target vehicle. Instead of nearby vehicles, the alert simulator system 105 may receive alert signals transmitted from other nearby vehicles. Any vehicle that receives the alert signal, such as the host vehicle 100 or a target vehicle, may output an audible representation of the alert signal via the vehicle's speakers. The audible representation of the alert signal may take any number of forms. For instance, the alert signal may be a horn beep, a voice recording, a live voice stream, a warning sound, etc. In addition to presenting the audible representation of the alert signal (referred to as the "alert sound"), the alert simulator system 105 may further present a graphical representation of which nearby vehicle transmitted the alert signal. The identification of the vehicle that initiated the alert signal may include a username or some other unique identifier, a directional identifier (in front of, next to, or behind the host vehicle 100), or the like. The unique identifier may be selected by the owner of the host vehicle 100 or assigned to the host vehicle 100 when, e.g., the host vehicle 100 is registered with a discovery database indicating that the host vehicle 100 is capable of sending alert signals, receiving alert signals, or both. The alert simulator system 105 can, therefore, query the discovery database to determine which nearby vehicles are equipped with a compatible alert simulator system 105. Further, in addition or as an alternative to the audible or visual alerts, the alert may be a haptic alert delivered to the driver of the host vehicle 100 via, e.g., a steering wheel or other object located in the host vehicle 100.

In addition to or instead of nearby vehicles, the alert simulator system 105 may be programmed to communicate with other types of remote devices such as a mobile device carried by a pedestrian. The alert simulator system 105 may, in one possible implementation, present graphical representations of the pedestrians based on, e.g., the presence of the pedestrian's mobile device. The alert simulator may receive a user input that includes a selection of one or more mobile devices and transmit the alert signal to the selected mobile device. In response to receiving the alert signal, the mobile device may generate an audible, visible, or tactile alert (e.g., vibrate) to make the pedestrian aware of the host vehicle 100. Likewise, the alert simulator system 105 may be programmed to receive alert signals from mobile devices. In response to receiving an alert signal from the mobile device, the alert simulator system 105 may output the alert sound via the vehicle speakers so that it can be heard in the passenger compartment of the host vehicle 100. In addition to the alert sound, the alert simulator system 105 may further present a graphical representation that identifies the pedestrian carrying the mobile device that initiated the alert signal. The identification of the pedestrian may include a username or some other unique identifier, a directional identifier (in front of, next to, or behind the host vehicle 100), or the like. The communication with the mobile device may be in accordance with any wireless telecommunication scheme. Moreover, as with vehicles, the mobile devices may be registered with the discovery database.

In some instances, the alert simulator system 105 may automatically transmit alert signals instead of or in addition to an actual horn beep in response to the driver of the host vehicle 100 pressing the horn button that is generally located in the center of the vehicle steering wheel or speaking a recognized voice command. For instance, the alert simulator system 105 may determine the time of day and only transmit alert signals (without the horn of the host vehicle 100 generating an audible noise) during certain times of day. If no particular target vehicle is selected, the alert simulator system 105 may transmit the alert signal to all nearby vehicles, mobile devices, or both.

The alert simulator system 105 may also automatically transmit alert signals based on the geographic location of the host vehicle 100. That is, the alert simulator system 105 may determine that the host vehicle 100 is in a quiet area (a suburban neighborhood) and only transmit alert signals instead of allowing the horn of the host vehicle 100 to generate an audible noise. If the alert simulator system 105 determines that the host vehicle 100 is in an especially noisy area, such as a downtown urban area or a construction zone, the alert simulator system 105 may transmit both the alert signal and generate an audible horn noise. Alternatively, in the noisy area, the alert simulator system 105 may only transmit the alert signal if it determines that the amount of noise in the area is too great for anyone to hear the audible horn or if the there is a desire for the host vehicle 100 to not contribute additional noise to an already noisy area.

Although illustrated as a sedan, the host vehicle 100 may include any passenger or commercial automobile such as a car, a truck, a sport utility vehicle, a crossover vehicle, a van, a minivan, a taxi, a bus, etc. In some possible approaches, the host vehicle 100 is an autonomous vehicle configured to operate in an autonomous (e.g., driverless) mode, a partially autonomous mode, and/or a non-autonomous mode.

Figure 2:
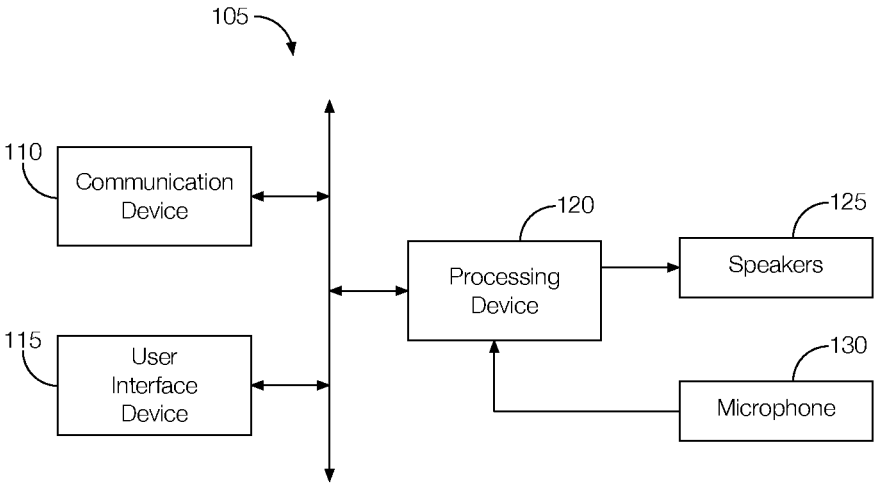
FIG. 2 is a block diagram showing example components of the system incorporated into the vehicle of FIG. 1.

Referring now to FIG. 2, the alert simulator system 105 may include a communication device 110, a user interface device 115, and a processing device 120.

The communication device 110 may include a data storage medium that stores computer-executable instructions associated with receiving alert signals, transmitting alert signals, or both. In some possible approaches, the communication device 110 may further include an antenna configured for wireless communication. The communication device 110 may include a processor programmed to access and execute the computer-executable instructions from the data storage medium. In some possible implementations, the communication device 110 may be programmed to transmit the alert signal from the host vehicle 100 to one or more selected target vehicles, pedestrians (via the pedestrian's mobile device), or both. Moreover, the communication device 110 may be programmed to receive and process alert signals transmitted from a nearby vehicle, a pedestrian's mobile device, or both. Thus, the communication device 110 may facilitate wireless communication among the components of the vehicle and remote devices, such as a corresponding communication device incorporated into a different vehicle via a vehicle-to-vehicle communication protocol or a mobile device, such as a cell phone via a cellular telecommunication protocol. Another remote device may include a communication device corresponding to an infrastructure device. An example of a vehicle-to-vehicle or vehicle-to-infrastructure communication protocol may include, e.g., the dedicated short range communication (DSRC) protocol.

In some possible approaches, the communication device 110 may be programmed to determine the location of the source of any received signals, including any received alert signals. In one possible implementation, the location of the source of the alert signals can be determined by location information included in the alert signal, as discussed in greater detail below. Alternatively, the location can be inferred from the strength of the alert signal or signals received via a microphone 130, as discussed in greater detail below.

In some possible implementations, the communication device 110 may include a geolocation detector that allows the position of the host vehicle 100 to be determined by the processing device 120 and transmitted to other vehicles via the communication device 110. The communication device 110 may further transmit velocity information representative of the present velocity of the host vehicle 100. Thus, when one vehicle honks another, the elevation, range, time rate of change in the range, and bearing between the vehicles can be computed and signal processing of the alert may give the driver the perception the alert is coming from the elevation, bearing and range of the source of the honk. This may apply to audible alerts, visual alerts, and haptic alerts.

The user interface device 115 may include a data storage medium that stores computer-executable instructions associated with presenting graphical representations of various objects such as other vehicles, pedestrians' mobile objects, etc., inside the host vehicle 100. The computer-executable instructions may be further associated with receiving user inputs. Further, the user interface device 115 may include a processor that can access and execute the computer-executable instructions stored in the data storage medium. The user interface device 115 may be located in the passenger compartment of the host vehicle 100, and in some instances, may include a touch-sensitive display screen or a voice-activated menu. Therefore, the user input may be provided by touching the display screen or speaking a recognized command.

While the host vehicle 100 is in operation, the user interface device 115 may be programmed to present graphical representations of nearby vehicles as potential target vehicles. The user interface device 115 may also or alternatively present graphical representations of pedestrians based on, e.g., a location of the pedestrian's mobile device relative to the host vehicle 100. The user interface device 115 may be programmed to permit an occupant of the host vehicle 100 to select one of the nearby vehicles or pedestrian mobile devices as a target for the alert signal. Selecting one of the nearby vehicles or pedestrian mobile devices may include the occupant of the host vehicle 100 touching the graphical representation of one of the nearby vehicles or pedestrian mobile devices or by speaking a recognized command and unique identifier associated with the nearby vehicle or pedestrian mobile device. The alert signal may be generated in response to the occupant providing the user input representing the selection of the target.

The processing device 120 may include a data storage medium that stores computer-executable instructions associated with transmitting the alert signal to target vehicles or pedestrian devices, receiving alert signals transmitted from target vehicles or pedestrian devices, or both. For instance, the processing device 120 may be programmed to receive a signal representing the user input from the user interface device 115. In response to receiving the user input signal, the processing device 120 may generate the alert signal and command the communication device 110 to transmit the alert signal to the selected target vehicle or pedestrian mobile device. The alert signal may be generated to include information about the host vehicle 100. The information may include a geographic location of the host vehicle 100, a unique identifier associated with the host vehicle 100, or any other information that may identify the host vehicle 100 to the target vehicle or pedestrian mobile device.

If an alert signal is received from a remote device, such as another vehicle or a pedestrian's mobile device, the processing device 120 may receive the alert signal from the communication device 110 and output the alert signal to a speaker 125 located inside the host vehicle 100. The speaker 125 may play an alert sound inside the passenger compartment of the host vehicle 100.

In some instances, the processing device 120 may process any received alert signals for information about the source of the alert signal. For instance, the processing device 120 may be programmed to extract, from the alert signal, geographic location information or a unique identifier associated with the source of the alert signal. The processing device 120 may be further programmed to command the user interface device 115 to display a graphical representation of the source of the alert signal to the occupants of the host vehicle 100. The graphical representation may indicate whether the alert signal originated from a nearby vehicle or a pedestrian's mobile device. The graphical representation may further identify where the source of the alert signal was located at the time the alert signal was transmitted. The location of the source of the alert signal may be relative to the host vehicle 100. For instance, the source may be identified as in front of, behind, to the left of, or to the right of the host vehicle 100. Thus, occupants of the host vehicle 100 will know who is trying to get their attention by way of the alert signal.

The volume of the audible alert signal may be based on a distance of the source that transmitted the alert signal to the host vehicle 100. The processing device 120, therefore, may be programmed to compare the location of the source (i.e., the nearby vehicle or remote device that transmitted the alert signal) to the location of the host vehicle 100 to determine the distance between the two. The location of the source may be determined from processing the alert signal to extract the location information, from the communication device 110 (e.g., the signal strength measurement), or a combination of both. The processing device 120 may output the alert signal to the speakers 125 in accordance with the distance. That is, the processing device 120 may output the alert signal to the speakers 125 in a way that causes the speakers 125 to play the alert sound at volume consistent with the distance. Thus, if the source of the alert signal is further away from the host vehicle 100, the alert sound will be played at a lower volume inside the passenger compartment than if the source of the alert signal is adjacent to the host vehicle 100 thereby simulating how the alert might be heard if it were broadcast as an audible signal from the source.

In some instances, the processing device 120 may be programmed to determine whether to output the alert signal to the speakers 125 in the host vehicle 100 at all. For instance, if the distance of the source of the alert signal to the host vehicle 100 is too great (e.g., greater than a predetermined value), the processing device 120 may simply ignore the alert signal so as not to startle or disrupt the occupants of the host vehicle 100 for an alert signal transmitted from a more remote vehicle or pedestrian mobile device. In an alternative approach, the processing device 120 may be programmed to receive all alert signals within range of the communication device 110 yet only process those that are less than a predetermined distance away. In other words, the processing device 120 may be programmed to only output alert signals to the speakers 125 in the host vehicle 100 if the alert signal originated from a distance less than a predetermined value away from the host vehicle 100. Thus, the processing device 120 may ignore alert signals generally broadcasted to all nearby vehicles, which may include the host vehicle 100, even if the host vehicle 100 is not a selected target. Further, allowing the processing device 120 to ignore certain alert signals may compensate for issues that may arise where the source is able to transmit the alert signal to a broader range than to nearby vehicles and pedestrian mobile devices that are "nearby."

The processing device 120 may be programmed to update the output of received alert signals according to user preferences. One user preference may set a maximum volume of the audible sound played by the speakers 125. Another user preference may temporarily disable any alert signals from being played in the host vehicle 100. In this instance, the processing device 120 may ignore received alert signals, and in some cases, the processing device 120 may command the communication device 110 to communicate to nearby sources that the host vehicle 100 is not able to receive alert signals. The user preferences may be provided via the user interface device 115, and signals representing the user preferences may be transmitted to or otherwise available to the processing device 120. For instance, the user preferences may be stored as data in a data storage medium accessible to the processing device 120.

In another possible approach, the processing device 120 may be programmed to account for environmental variables like cabin noise when outputting the alert signals. A mobile device or a microphone 130 in the host vehicle 100 may sense acoustic noise for the system 105, and vehicle sensors could sense other factors like temperature, fog, etc. In response to the signals received via the mobile device, microphone 130, other vehicle sensors, etc., the processing device 120 may adjust the volume or other characteristic, including whether the alert is presented audibly, visually, or haptically in the host vehicle 100.

In some instances, alerts may be generated automatically under certain circumstances. For instance, if the cruise control module determines that it cannot stop the host vehicle 100 in time to avoid a collision with the vehicle ahead, an alert may be sent to the other vehicle with a squealing tires signal modified to make it sound like squealing tires are coming from behind, with loudness rising as the vehicles get closer and a synthetic Doppler shift that changes as the relative velocity of the vehicles changes. This may alert the driver to take a protective action.

Figure 3:
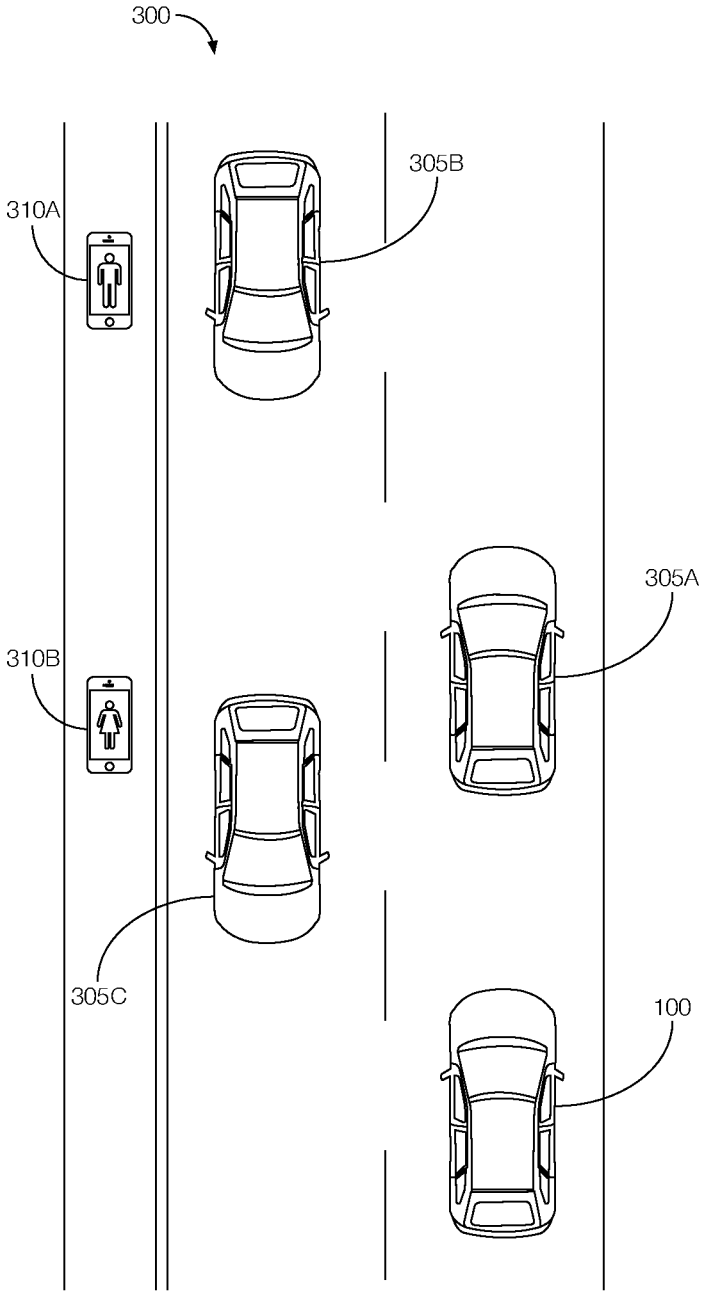
FIG. 3 is an example graphical user interface showing potential target vehicles that can receive alert signals transmitted from the host vehicle.

FIG. 3 is an example graphical user interface 300 showing graphical representations of potential target vehicles 305A-305C and pedestrian mobile devices 310A-310B that can receive alert signals transmitted from the host vehicle 100. The graphical representations of the target vehicles 305A-305C and pedestrian mobile devices 310A-310B may include a unique status identifier, such as a username, that may be selected or provided by the owner of the potential target vehicle or may be assigned to the target vehicle. One or more target vehicles 305A-305C and pedestrian mobile devices 310A-310B may be selectable via a user input provided to the user interface device 115. For instance, the user input may include an occupant of the host vehicle 100 touching one or more of the graphical representations of the target vehicles 305A-305C and pedestrian mobile devices 310A-310B. In response to the user input, the alert simulator system 105 may generate and transmit the alert signal to the selected target vehicles 305A-305C and pedestrian mobile devices 310A-310B. If no nearby vehicles 305A-305C and pedestrian mobile devices 310A-310B are selected, the alert signal may be broadcast to all nearby vehicles 305A-305C and pedestrian mobile devices 310A-310B when, e.g., the occupant of the host vehicle 100 actuates the horn switch located in the steering wheel of the host vehicle 100 or speaks a recognized command to send the alert signal.

Figure 4:
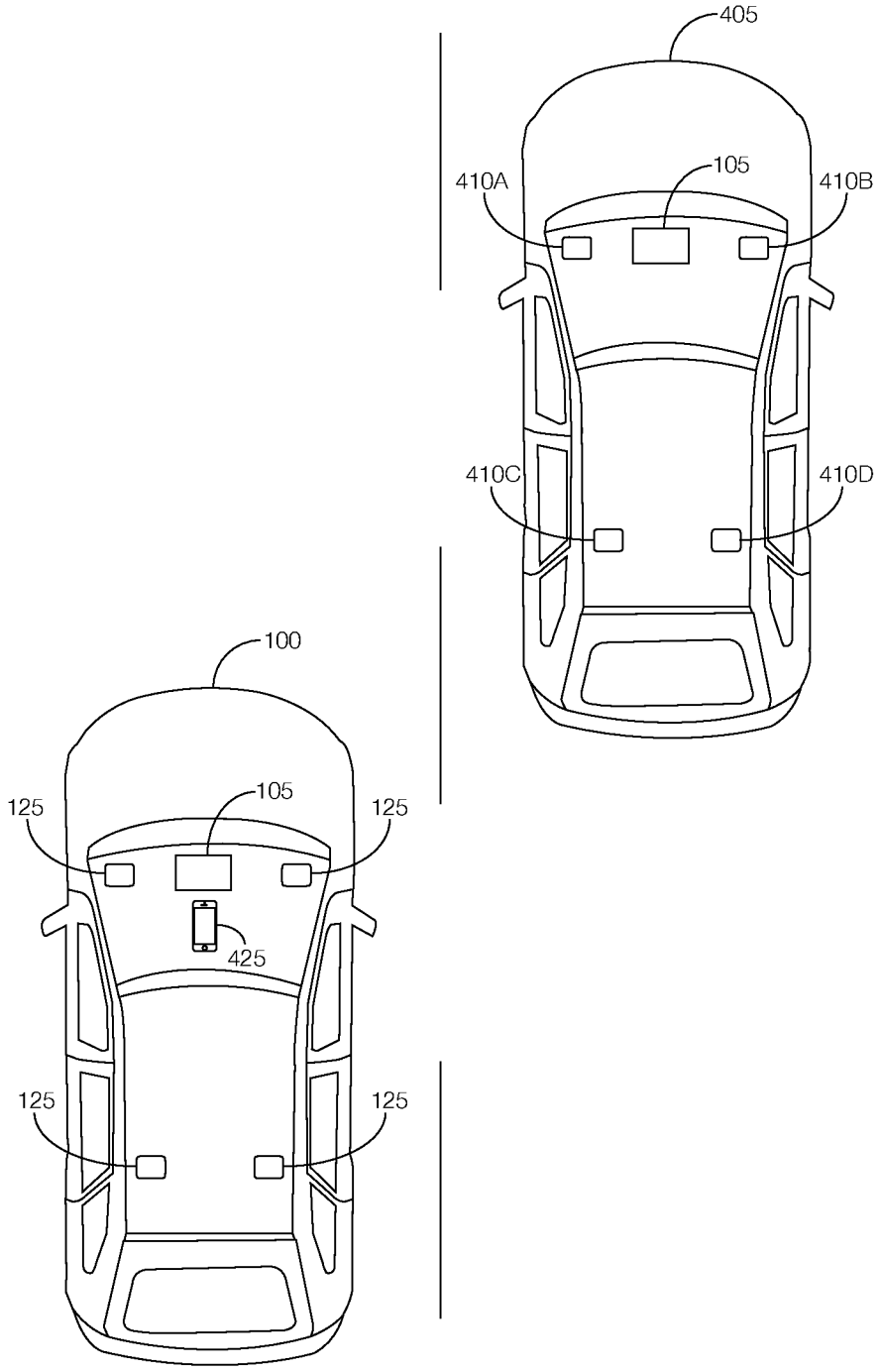
FIG. 4 illustrates an example host vehicle and an example target vehicle.

FIG. 4 illustrates an example host vehicle 100 and an example target vehicle 405. The target vehicle 405 may include various speakers 410A-410D that can be arranged in certain pairs to provide a sense of directionality to the alert signal transmitted from the host vehicle 100. The host vehicle 100, as shown, is behind the target vehicle 405 on the driver side. Therefore, the speakers 410A-410D of the target vehicle 405 may reflect that location of the host vehicle 100 relative to the target vehicle 405. For instance, only speaker 410C may output the audible sound associated with the alert signal. If the host vehicle 100 were directly behind the target vehicle 405, the speakers 410C and 410D may output the audible sound associated with the alert signal. If the host vehicle 100 were in front of the target vehicle, the speakers 410A and 410B may output the audible sound associated with the alert signal. If the host vehicle 100 were next to the target vehicle 405 on the passenger side, the speakers 410B and 410D may output the audible sound associated with the alert signal. These are just a few examples of the potential speaker pairings that may simulate the direction of the origination of the alert signal.

Further, as shown in FIG. 4, the host vehicle 100 may include mobile device 415 that can be used as the user interface device 115. That is, the mobile device 415 may be located in the passenger compartment of the host vehicle 100 and may allow an occupant in the host vehicle 100 to provide the user input selecting the target vehicle 405. The user input provided to the mobile device 415 may be transmitted to the processing device 120.

Figure 5:
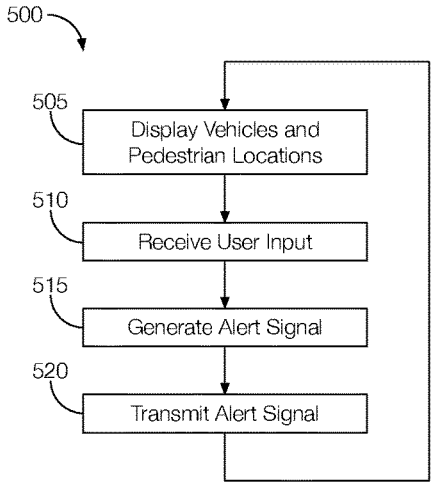
FIG. 5 is a flowchart of an example process that may be executed by the system of FIG. 1 to transmit alert signals to other vehicles.

FIG. 5 is a flowchart of an example process 500 that may be executed by the alert simulator system 105 to transmit alert signals to other vehicles. The process 500 may be executed at any time while the host vehicle 100 is operating.

At block 505, the alert simulator system 105 may present graphical representations of nearby vehicles, nearby pedestrian mobile devices, or both. The graphical representations may be presented via the user interface device 115 located inside the host vehicle 100. As discussed above, in one possible approach, the user interface device 115 may be in the form of an occupant's mobile device, such as a cell phone. The presence of nearby vehicles or a pedestrian's mobile device may be based on signals received via the communication device 110. Moreover, the alert simulator system 105 may query the discovery database to determine which, if any, nearby vehicles are equipped with comparable systems that can receive alert signals. Further, prior to presenting the graphical representation, the processing device 120 may compare the location of the host vehicle 100 to the location of the potential target vehicles and potential pedestrian mobile devices. The processing device 120 may cause the user interface device 115 to omit potential target vehicles and devices that are too far away (e.g., the distance between the host vehicle 100 and the potential target vehicles or devices is greater than a predetermined value) from display on the user interface device 115.

At block 510, the alert simulator system 105 may receive a user input representing a selection of one or more target vehicles, one or more pedestrian mobile devices, or a combination of target vehicles and pedestrian devices. The user input may be received via the user interface device 115. For instance, the user input may be provided by, e.g., an occupant of the host vehicle 100 pressing a part of the touch-sensitive display screen where the graphical representation of the target vehicle is located or by speaking the unique identifier of the target vehicle. In some instances, multiple user inputs may be provided. For instance, one user input (pressing the touch-sensitive display screen or providing a voice command) may select the target vehicle or pedestrian mobile device while another user input may indicate the occupant's desire to "honk" at the selected vehicle or mobile device. In response to the user input, the user interface device 115 may output a signal representing the selection, the command to "honk," or both, to the processing device 120.

At block 515, the alert simulator system 105 may generate an alert signal. The alert signal may be generated by the processing device 120 and may include, e.g., an instruction to provide an alert to an occupant of the selected vehicle, to a pedestrian carrying the selected mobile device, etc. The alert may be in the form of an audible alert such as a horn beep, a visual alert such as a display presented in the target vehicle or on the selected mobile device, or a haptic alert such as vibration of a steering wheel in the target vehicle or vibration of the selected mobile device. The alert signal may further include the location of the host vehicle 100 and a unique identifier associated with the host vehicle 100.

At block 520, the alert simulator system 105 may transmit the alert signal to the selected target vehicle, mobile device, or both. Transmitting the alert signal may include the processing device 120 commanding the communication device 110 to wirelessly communicate the alert signal according to any number of wireless communication protocols. And because the alert signal may include the location of the host vehicle 100 and the unique identifier, transmitting the alert signal may further include transmitting the location of the host vehicle 100 and identifying the host vehicle 100 (by unique identifier) to the selected target vehicle, mobile device, or both.

The process 500 may end after block 520 or may return to block 505 so that it can be ready to receive a subsequent user input.

Figure 6:
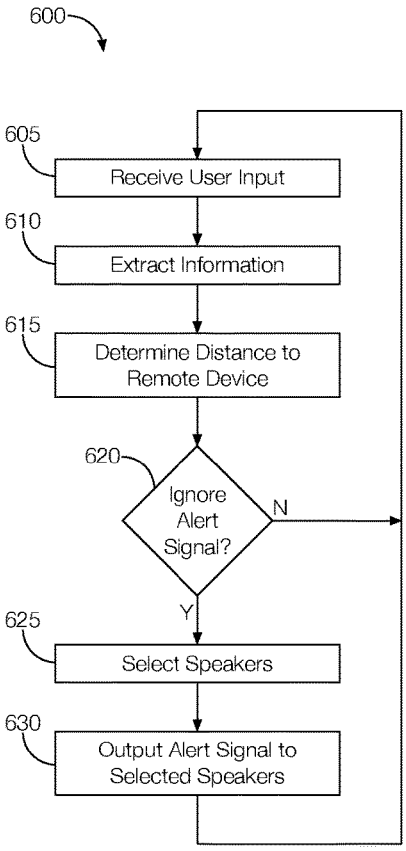
FIG. 6 is a flowchart of an example process that may be executed by the system of FIG. 1 to receive alert signals from other vehicles and play alert sounds in the host vehicle.

FIG. 6 is a flowchart of an example process 600 that may be executed by the alert simulator system 105 to receive alert signals transmitted from other vehicles or pedestrian mobile devices and play alert sounds in the host vehicle 100.

At block 605, the alert simulator system 105 may receive an alert signal transmitted from a remote device. The remote device may include a system incorporated into another vehicle, a pedestrian's mobile device, etc. The alert signal may be received via the communication device 110 and passed to the processing device 120.

At block 610, the alert simulator system 105 may extract information from the alert signal. The processing device 120 may, for instance, extract the location information from the alert signal. The location information may indicate the location of the remote device that transmitted the alert signal. The location may include an absolute location (e.g., GPS coordinates) or a relative location (e.g., in front of, behind, or next to the host vehicle 100 and whether it is on the driver or passenger side relative to the host vehicle 100).

At block 615, the alert simulator system 105 may determine a distance to the remote device. The distance may be determined by the processing device 120 based on the location information extracted at block 610. The processing device 120 may compare the location of the remote device that transmitted the alert signal to the location of the host vehicle 100. The comparison may yield the distance.

At decision block 620, the alert simulator system 105 may determine whether to ignore the alert signal. The processing device 120 may, in one possible approach, compare the distance determined at block 620 to a predetermined value. If the distance exceeds the predetermined value, the processing device 120 may determine that the alert signal should be ignored as too far away from the host vehicle 100. If ignored, the process 600 may proceed to block 605 to await a new alert signal. If the distance does not exceed the predetermined value, the process 600 may proceed to block 625.

At block 625, the alert simulator system 105 may determine which speakers 125 should output the alert sound. Using relative location information extracted or derived from the alert signal at block 610, the processing device 120 may determine whether the alert signal originated in front of, next to, or behind the host vehicle 100. If next to, the processing device 120 may determine whether the alert signal originated on the driver or passenger side of the host vehicle 100. The processing device 120 may combine two or more positions to determine the relative location. For instance, the processing device 120 may determine that the alert signal originated from the driver side but slightly ahead of or behind the host vehicle 100. Another alternative could include originating from the passenger side but slightly ahead of or behind the host vehicle 100. The relative location may be used to determine which speaker 125 or pair of speakers 125 to output the alert sound. If the alert signal originated at least partially behind the host vehicle 100, the processing device 120 may select one or more rear speakers 125. If the alert signal at least partially originated from the driver side, the processing device 120 may select one or more driver-side speakers 125. If the alert signal at least partially originated from the passenger side, the processing device 120 may select one or more passenger-side speakers 125. If the alert signal at least partially originated from ahead of the host vehicle 100, the processing device 120 may select one or more front speakers 125. Instead of or in addition to selecting speakers 125 or speaker 125 pairs, the processing device 120 may command certain speakers 125 to output the alert sound at different volumes. The speakers 125 closest to where the alert signal originated may play the alert sound louder than one or more other speakers 125 in the vehicle. The audio output may be more sophisticated than simply selecting speakers 125. Since the perceived location of the sound can also be affected by the audio equalizer/compressor, phase shifts between frequencies, and relative loudness of the sound produced by each speaker, the relative velocities of the two vehicles can be used to compute a synthetic Doppler shift in the tone of the alert that may give a perception of the relative speed of the vehicles. The human auditory system can resolve direction with about 15° accuracy behind the head and 1° in front. That same level of resolution may be simulated by the system 105 via the speaker 125 selection and corresponding outputs. Sounds can also be perceived to come from locations above the vehicle, for example, when the vehicle is alerted by a sign or by aircraft.

At block 630, the alert simulator system 105 may generate the sound in accordance with the alert signal. The processing device 120 may, in one possible implementation, output the alert signal to the speakers 125 identified at block 625. Outputting the alert signal may include controlling which speakers 125 receive the alert signal, and in some instances, the volume at which the alert sound will be played through each speaker 125. Further, the processing device 120 may select a particular sound to play in response to the alert signal. The alert sound may include a horn beep, a voice recording, a live voice stream, a warning sound, etc.

The process 600 may return to block 605 after the alert sound has been played in the passenger compartment of the host vehicle 100.

Accordingly, the alert simulator system 105 allows the driver of the host vehicle 100 to select particular recipients of the alert sound, which may increase the likelihood that the alert will be heard and acknowledged by the intended recipient. Further, the alert simulator system 105 permits the host vehicle 100 to receive alert signals from other nearby vehicles and pedestrians, which may increase the likelihood that the driver of the host vehicle 100 will hear and acknowledge alert sounds directed at the host vehicle 100.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A vehicle system comprising:

a communication device programmed to transmit a first alert signal from a host vehicle to at least one target vehicle and to receive a second alert signal transmitted from a remote device;

a user interface device programmed to present a graphical representation of the at least one target vehicle and receive a user input representing a selection of the at least one target vehicle; and a processing device programmed to command the communication device to transmit the first alert signal to the selected at least one target vehicle in response to the user interface device receiving the user input representing the selection of the at least one target vehicle;

wherein the processing device is in communication with a speaker in the host vehicle and programmed to output the second alert signal received from the remote device to the speaker in the host vehicle; and wherein the communication device is further programmed to receive a location of the remote device, and wherein the processing device is programmed to compare the location of the remote device to a location of the host vehicle and output the second alert signal to the speaker in accordance with a distance between the host vehicle and the remote device.

2. The vehicle system of claim 1, wherein the communication device is programmed to transmit the first alert signal from the host vehicle to at least one mobile device.

3. The vehicle system of claim 2, wherein the user interface device is programmed to present a graphical representation of the at least one mobile device and receive a user input representing a selection of the at least one mobile device.

4. The vehicle system of claim 3, wherein the processing device is programmed to command the communication device to transmit the first alert signal to the selected at least one mobile device in response to the user interface device receiving the user input representing the selection of the at least one mobile device.

5. The vehicle system of claim 1, wherein the remote device includes at least one of the at least one target vehicle and at least one mobile device.

6. The vehicle system of claim 1, wherein the processing device is programmed to output the second alert signal to the speaker if the distance between the host vehicle and the remote device is less than a predetermined value.

7. The vehicle system of claim 1, wherein the communication device is programmed to transmit a location of the host vehicle with the first alert signal.

8. A method comprising:

presenting, on a user interface device in the host vehicle, a graphical representation of the at least one target vehicle;

receiving a user input representing a selection of the at least one target vehicle; and transmitting an alert signal from the host vehicle to the selected at least one target vehicle in response to receiving the user input;

receiving a second alert signal transmitted from a remote device;

outputting the second alert signal received from the remote device to a speaker in the host vehicle;

receiving a location of the remote device; and comparing the location of the remote device to a location of the host vehicle to determine a distance between the host vehicle and the remote device, and wherein outputting the second alert signal to the speaker includes outputting the second alert signal to the speaker based on the distance between the host vehicle and the remote device.

9. The method of claim 8, further comprising transmitting the alert signal from the host vehicle to at least one mobile device.

10. The method of claim 9, further comprising:

presenting a graphical representation of the at least one mobile device; and receiving a user input representing a selection of the at least one mobile device.

11. The method of claim 10, further comprising transmitting the first alert signal to the selected at least one mobile device in response to receiving the user input representing the selection of the at least one mobile device.

12. The method of claim 8, wherein the remote device includes at least one of the at least one target vehicle and at least one mobile device.

13. The method of claim 8, wherein outputting the second alert signal to the speaker includes outputting the second alert signal to the speaker if the distance between the host vehicle and the remote device is less than a predetermined value.

14. The method of claim 8, further comprising transmitting a location of the host vehicle to the selected at least one target vehicle.

* * * * *